US005533335A

United States Patent [19]

Shin

[11] Patent Number: 5,533,335

[45] Date of Patent: Jul. 9, 1996

[54] CAM DRIVING APPARATUS FOR A STIRLING CYCLE MODULE

[75] Inventor: Dong-Koo Shin, Kyungki-Do, Rep. of Korea

[73] Assignee: Goldstar Co., Ltd., Rep. of Korea

[21] Appl. No.: 334,607

[22] Filed: Nov. 4, 1994

[30] Foreign Application Priority Data

Nov. 4, 1993 [KR] Rep. of Korea ..... 23340/1993

[51] Int. Cl.[6] ..... F02G 1/043

[52] U.S. Cl. ..... 60/517; 60/519

[58] Field of Search ..... 60/517, 519

[56] References Cited

U.S. PATENT DOCUMENTS

| | | | |
|---|---|---|---|
| 2,475,770 | 7/1949 | Wijsman | 60/525 |
| 3,385,051 | 5/1968 | Kelly | 60/525 |
| 5,442,913 | 8/1995 | Cho et al. | 60/519 |

*Primary Examiner*—Leonard E. Heyman

*Attorney, Agent, or Firm*—Ostrolenk, Faber, Gerb & Soffen

[57] ABSTRACT

A cam driving apparatus for a Stirling cycle module in which a circumferential surface of a rotary cam is equipped with an upper cam curve profile and a lower cam curve profile thus achieving a light and compact cam module. It includes a displacer disposed inside a cylinder for controlling a flow of active gas in the cylinder of a Stirling cycle module; a piston, disposed below the displacer, for controlling a flow of active gas in a cylinder of a Stirling cycle module, a cylindrical rotary cam equipped with a circumferential cam groove having an upper cam curve profile and a lower cam curve profile which have a predetermined width and depth therebetween; a displacer connecting rod drivingly connecting the cylindrical cam and the displacer and including a plurality of displacer connecting rod bearings at driving ends thereof; a piston connecting rod drivingly connecting the cylindrical cam and the piston and including piston connecting rod bearings at driving ends thereof; and a guide member disposed between the piston and the cam and including a piston connecting rod guiding grooves and a displacer connecting rod guiding groove formed therethrough.

4 Claims, 4 Drawing Sheets

CAM DRIVING APPARATUS FOR A STIRLING CYCLE MODULE

BACKGROUND OF THE INVENTION

1. Field of the Invention

The present invention relates in general to a cam driving apparatus for a Stirling cycle module, and in particular to a cam driving apparatus in which a circumferential surface thereof is equipped with an upper cam curve portion and a lower cam curve portion thus achieving a light and compact cam module driving apparatus.

2. Description of the Conventional Art

Referring to FIG. 1 and FIG. 2, there is shown a conventional cam driving apparatus for a Stirling cycle module. A displacer 1 is disposed at an inside upper portion of a cylinder(not shown) in order to control an active gas in a cylinder. A piston 2 is disposed below the displacer 1 and operated in a different cycle from the displacer 1 in order to control the active gas in a cylinder. Here, a cam driving section 30 includes a rotary cylindrical cam 7 and a plurality of displacer connecting rod bearings 8 and a plurality of piston connecting rod bearings 8'. The cylindrical cam 7 has a peripheral cam groove 12 formed therein with a two-cycle sine curve configuration and is disposed below the piston 2. Here, the bottom portion of the displacer 1 is connected with the upper end of a displacer connecting rod 4 from a lower end of which depend a pair of displacer connecting rod forks **4*a* and 4*b* and the lower ends thereof are each equipped with the displacer connecting rod bearings 8. The displacer connecting rod bearings 8 are slidably engaged into the cam groove 12. The piston is centrally formed with a through bore hole 2' which is slidable along the connecting rod 4 of the displacer 1. The bottom surface of the piston 2 is connected with the upper ends of two piston connecting rods 3 and the lower ends of both piston connecting rod 3 are equipped with the piston connecting rod bearings 8', respectively. The piston connecting rod bearings 8' are slidably engaged into the cam groove 12. Here, the displacer connecting bearings 8 and the piston connecting rod bearings 8' are separated circumferentially from each other along the cam groove 12 in order to avoid interfering with one another while running along the cam groove 12**.

Meanwhile, the piston 2 and the cam driving section 30 are divided from each other by a guide plate 5. Here, the guide plate 5 has a displacer connecting rod guiding opening 6' formed centrally therethrough in order to guide a vertical movement of the displacer connecting rod 4. In addition, a plurality of piston connecting rod guiding openings **5*b* are formed at predetermined portions of the guide plate 5 in order to guide a vertical movement of the piston connecting rods 3**.

The operation of the conventional cam driving apparatus for a Stirling cycle module will now be described with reference to FIG. 1 and FIG. 2.

To begin with, the displacer connecting rod bearings 8 and the piston connecting rod bearings 8' which are slidably engaged into the cam groove 12 run along a two-cycle sine curve portion, formed in the circumferencial surface, of the cam groove 12 as the cylindrical cam 7 rotates. The displacer connecting rod 4 and integral forks **4*a* and 4*b* equipped with the displacer connecting rod bearings 8 at both ends thereof vertically reciprocates in the cam groove and therefore the displacer 1 vertically reciprocates in the cylinder. Meanwhile, the piston connecting rods 3 equipped with the piston connecting rod bearings 8' at the lower ends thereof vertically reciprocate in the cam groove 12 and therefore the piston 2 vertically reciprocates in the cylinder in a different cycle from the displacer 1. While the displacer 1 and the piston 2 run as aforementioned, vibration occurs therein due to a high speed rotation of the cam. For preventing the vibration at the displacer connecting rod 4, there is formed the displacer connecting rod guiding opening 6' in the center portion of the guide plate 5 and for preventing the vibration at the piston connecting rods 3, there are formed the plurality of piston connecting rod guiding openings 5*a* and 5*b* in the guide plate 5**.

In the aforementioned structure of the conventional Stirling cycle module driving apparatus, if it is attempted to downsize the Stirling module by decreasing the diameter of the cylindrical cam 7, the displacer connecting rod bearings 8 disposed at predetermined distances from the piston connecting rod bearings 8' interfere with one another during running along the cam groove 12. In addition, if in order to resolve the problem, if the diameter of the cylindrical cam 7 is increased, thereafter the size of the cylinder become increased, and thus the circumferential rotation speed of the cylindrical cam 7 becomes slow, so that it is difficult to make the size of the cylindrical cam smaller. Otherwise, it is required to make the pans of the Stirling cycle module cam driving apparatus able to cope with the high speed for a predetermined rotation speed of the cylindrical cam, which makes the cost too high.

SUMMARY OF THE INVENTION

Accordingly, it is an object of the present invention to provide a cam driving apparatus for a Stirling cycle module in which a circumferential surface of the cam is equipped with an upper cam curve and a lower cam curve, thus achieving a compact and light cam driving apparatus.

To achieve the object of the present invention, the present cam driving apparatus includes a displacer disposed inside a cylinder for controlling a flow of active gas in the cylinder of a Stirling cycle module; a piston, disposed below the displacer, for controlling a flow of active gas in the cylinder of the Stirling cycle module; a cylindrical cam equipped with a peripheral cam groove having an upper cam curve portion and a lower cam curve portion which have a predetermined width and depth therebetween; a plurality of displacer connecting rods, drivingly connecting the cylindrical cam and the displacer and each having displacer connecting rod bearing at an outer end thereof; a piston connecting rod drivingly connecting the cylindrical cam and the piston including a plurality of piston connecting rod beatings at ends thereof; and a guide member disposed between the piston and the cam and having including a plurality of piston connecting rod guiding groove and a displacer connecting rod guiding groove formed therethrough.

BRIEF DESCRIPTION OF THE DRAWINGS

The objects and features of the invention may be more readily understood with reference to the following detailed description of an illustrative embodiment of the invention, taken together with the accompanying drawings in which.

DESCRIPTION OF THE PREFERRED EMBODIMENTS

Figure 1:
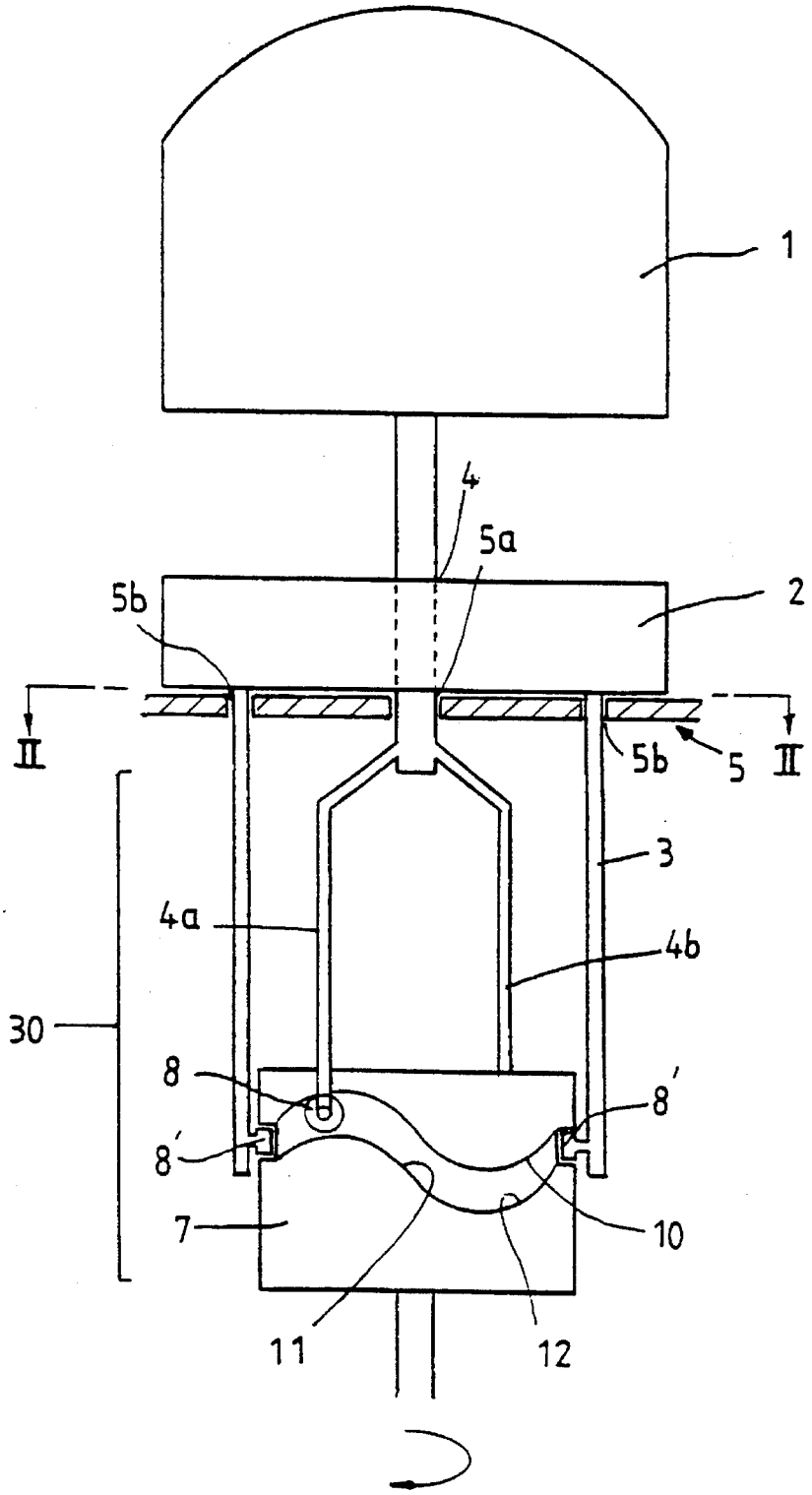
FIG. 1 CONVENTIONAL ART
FIG. 1 is a cross-sectional view showing a structure of a conventional Stirling cycle module driving apparatus.
Figure 2:
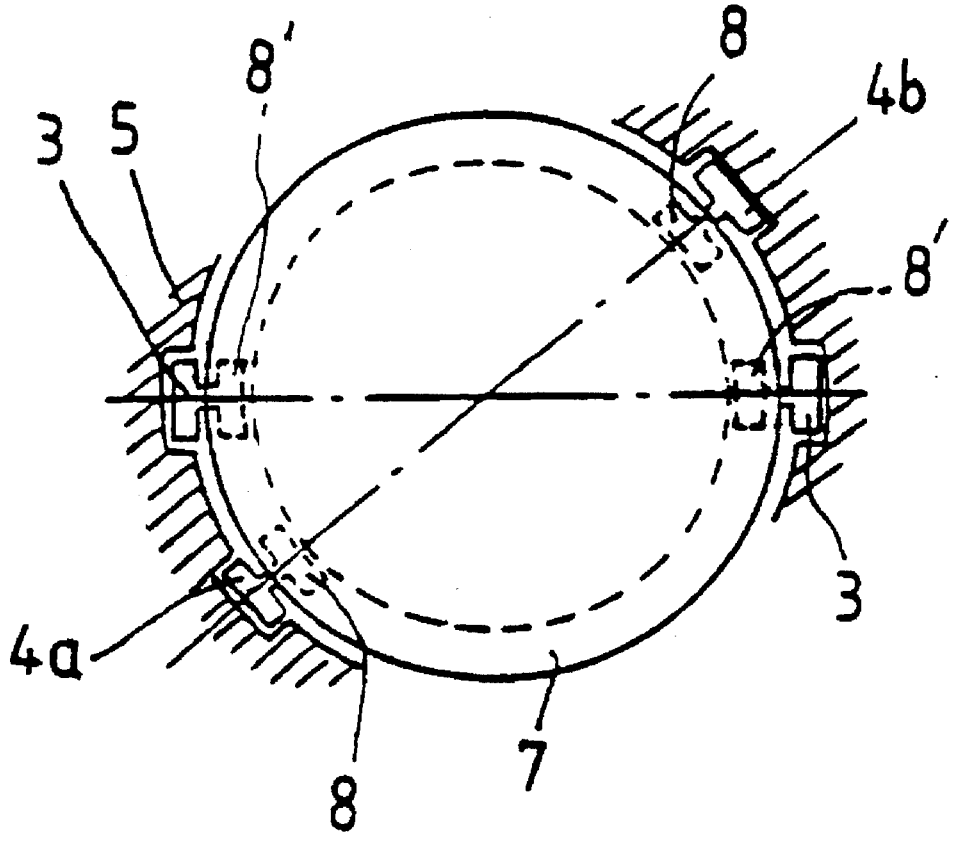
FIG. 2 CONVENTIONAL ART
FIG. 2 is a cross-sectional view taken along line II—II in FIG. 1.
Figure 3:
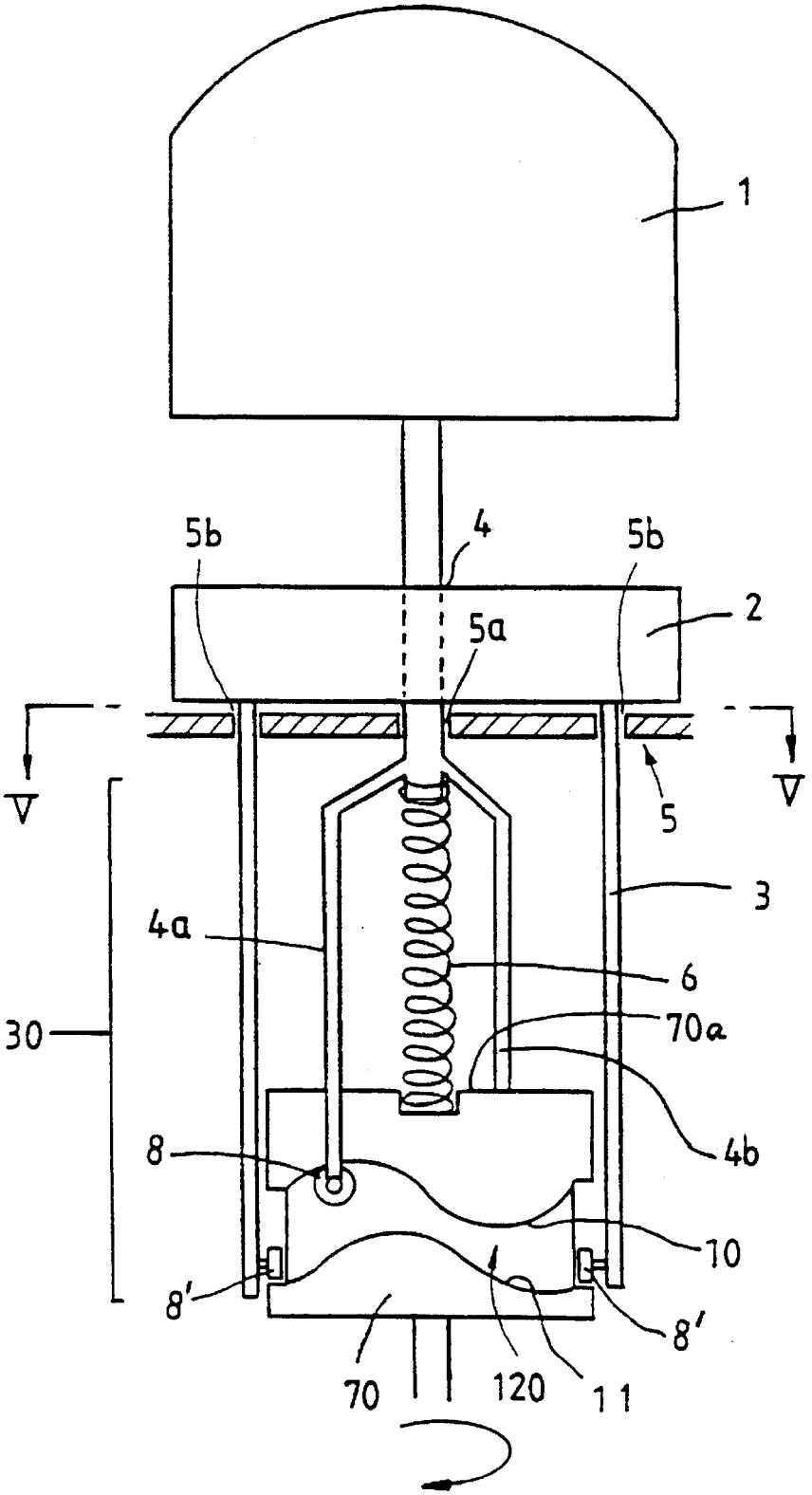
FIG. 3 is a cross-sectional view showing a structure of a Stirling cycle module driving apparatus according to the present invention.
Figure 4:
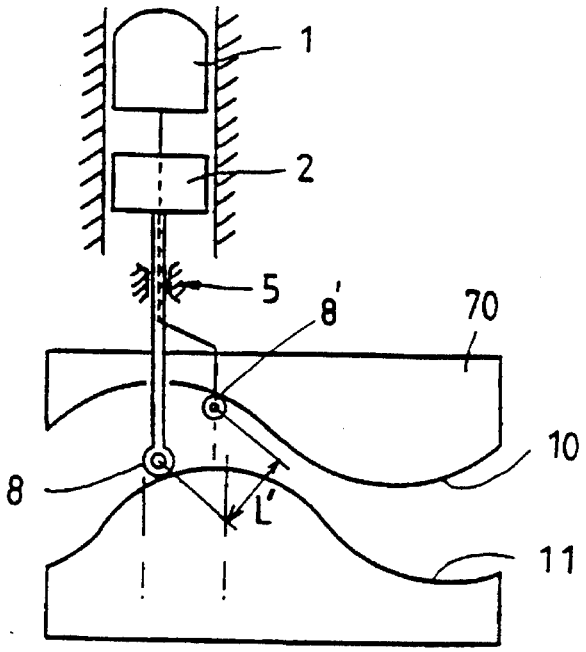
FIG. 4 is a cross-sectional view taken along a line V—V in FIG. 3, and according to the present invention, for illustrating a configuration of the cam driving arrangement.
Figure 5:
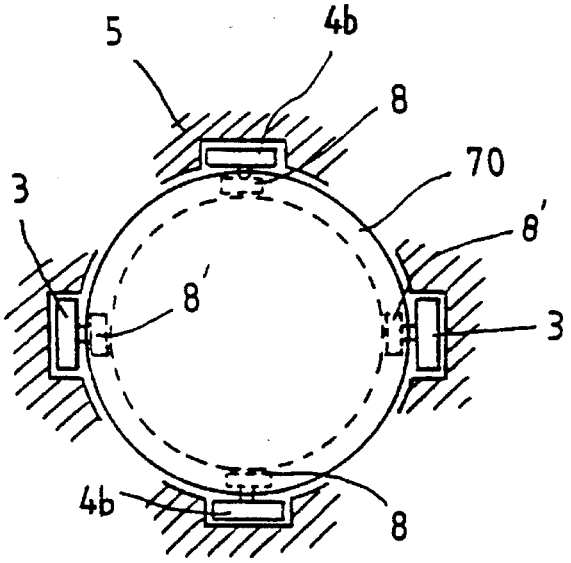
FIG. 5 is a cross-sectional view taken along a line V—V in FIG. 3.

Referring to FIG. 3 to FIG. 5, a cam driving section 30 includes a cylindrical cam 7 and a plurality of connecting rod bearings 8 and 8'. A displacer 1 is disposed at an inside upper portion of a cylinder(not shown) in order to control an active gas in the cylinder. A piston 2 is disposed below the displacer 1 and operated in a different cycle from the displacer 1 in order to control the active gas in the cylinder. A cylindrical cam 70 having a cam groove 120 formed in the circumferential thereof with a two-cycle sine curve configuration is disposed below the piston 2. Here, the bottom portion of the displacer 1 is connected with the upper end of the displacer connecting rod 4 and the lower ends of the depending forks 4*a* and 4*b* are each equipped with a displacer connecting rod bearing 8. The displacer connecting rod bearings 8 are slidably engaged on an upper cam curve profile 10 of the cam groove 120. The bottom portion of the piston 2 is connected with the upper ends of two piston connecting rods 3 and the lower ends of the both piston connecting rods 3 are equipped with a piston connecting rod bearing 8', respectively. The piston connecting rod bearings 8' are slidably engaged on a lower cam curve profile 11. Here, the displacer connecting bearings 8 and the piston connecting rod bearings 8' are separated from each other by a predetermined distance L' as shown in FIG. 4. Here, each of the displacer con connecting rod 15 bearings 8' are disposed at a location spaced apart from each other by a predetermined distance in order to avoid interference with one another.

Meanwhile, the piston 2 and the cam driving section 30 are separated from each other by a guide plate 5. Here, the guide plate 5 is centrally provided with a displacer connecting rod guiding groove 5*a* formed therethrough in order to guide a vertical movement of the displacer connecting rod 4. In addition, a plurality of piston connecting rod guiding groove 5*b* are formed through predetermined portions of the guide plate 5 of the guiding portion 5 in order to guide a vertical movement of the piston connecting rods 3.

A spring 6 is disposed between a lower branching-portion 4*c* of the displacer connecting rod 4 and an upper surface 70*a* of the cylindrical cam 70 in order to avoid a dangling of the displacer connecting rod bearings 8 while the displacer connecting rod bearings 8 run from the top portion to the lower portion of the upper cam curve profile 10.

While the displacer 1 and the piston 2 run as aforementioned, vibration occurs therein due to a high speed rotation thereof. For preventing the vibration at the displacer connecting rod 4, there is formed the displacer connecting rod guiding hole 5*a* and for preventing the vibration at the piston connecting rods 3, there are formed the piston connecting rod guiding holes 5*b* in the guiding plate 5.

The operation of the cam driving apparatus for a Stirling cycle module according to the present invention will be described with reference to FIG. 3 and FIG. 5.

To begin with, the displacer connecting rod bearings 8 and the piston connecting rod bearings 8' run along the upper cam curve profile 10 and the lower cam curve profile 11, respectively. As a result, the displacer connecting rod 4 and the piston connecting rods 3 vertically reciprocate and therefore the displacer 1 and the piston 2 are vertically reciprocated thereby. Meanwhile, the piston connecting rods 3 equipped with the piston connecting rod bearings 8' at the lower ends thereof vertically reciprocates and therefore the piston 2 vertically reciprocates in a different cycle from the displacer 1.

The effects of the Stirling cycle module driving apparatus according to the present will now be described with reference to FIG. 5.

The distance L' which is a distance between the piston connecting rod bearings 8 and the displacer connecting rod bearings 8' is greater than that of the conventional Stirling cycle module cam driving apparatus, so that interference therebetween can be avoided and therefore the diameter of the cylindrical cam 70 can be advantageously reduced and a smaller one can be utilized thereby.

Although the preferred embodiment of the present invention has been disclosed for illustrative purposes, those skilled in the art will appreciate that various modifications, additions and substitution are possible, without departing from the scope and spirit of the invention as recited in the accompanying claims.

What is claimed is:

1. A cam driving apparatus for a Stirling cycle module, comprising:

displacer means, disposed inside a cylinder, for controlling a flow of active gas in a cylinder of a Stirling cycle module;

piston means, associated with the displacer, for controlling a flow of active gas in a cylinder of a Stirling cycle module;

a rotary cylindrical cam means with a single cam groove having varying with formed circumferentially thereon and having an upper cam curve profile formed by an upper edge of said groove and a lower cam curve profile formed by an lower edge of said groove, said groove having a predetermined depth;

displacer connecting rod means for drivingly connecting the cylindrical cam means and the displacer means, including displacer connecting rod bearings at driving ends thereof for engaging said upper cam curve profile; and piston connecting rod means, drivingly connecting the cylindrical cam means and the piston means and including piston connecting rod bearing at driving ends thereof for engaging said lower cam curve profile.

2. The apparatus of claim 1, wherein said upper cam curve profile and said lower cam curve profile are each formed as a two-cycle sine curve.

3. The apparatus of claim 1, wherein said displacer connecting rod bearing means slidably run along the upper cam curve portion and said piston connecting rod bearings slidably run along the lower cam curve portion.

4. The apparatus of claim 1, wherein a spring is provided between said displacer connecting rod means and an upper surface of cam means.

* * * * *